US005715617A

United States Patent [19]

Ros

[11] Patent Number: 5,715,617

[45] Date of Patent: Feb. 10, 1998

[54] METHOD OF SECURING A COVER PLATE TO A STEAM CHAMBER OF AN IRON AND SOLEPLATE AND IRON

[75] Inventor: Franciscus C. C. Ros, Eindhoven, Netherlands

[73] Assignee: U.S. Philips Corporation, New York, N.Y.

[21] Appl. No.: 800,635

[22] Filed: Feb. 14, 1997

[30] Foreign Application Priority Data

Feb. 27, 1996 [EP] European Pat. Off. ..... 96200508

[51] Int. Cl.[6] ..... D06F 75/18; B29C 43/18

[52] U.S. Cl. ..... 38/77.83; 38/88; 38/93; 29/509; 29/521

[58] Field of Search ..... 38/77.83, 93, 88; 29/451, 453, 506, 508, 510, 511, DIG. 43, 445, 521, 522, 589, 243.17–243.19, 243.529, 524, 525

[56] References Cited

U.S. PATENT DOCUMENTS

| | | | |
|---|---|---|---|
| 4,277,900 | 7/1981 | Gowdy | 38/77.83 |
| 4,711,010 | 12/1987 | Walter | 38/77.83 X |
| 4,760,634 | 8/1988 | Rapp | 29/243.519 X |
| 4,896,415 | 1/1990 | Bock | 29/453 |
| 5,615,500 | 4/1997 | Moalem et al. | 38/88 X |

*Primary Examiner*—Ismael Izaguirre
*Attorney, Agent, or Firm*—Ernestine C. Bartlett

[57] ABSTRACT

The invention provides a method of securing a cover plate (6) onto a steam chamber (4) of a steam chamber and is characterized by the following steps:

forming recesses (12) in the cover plate (6) in such a manner that cups (13) are formed which project from the surface of the cover plate, fitting the cover plate (6) onto bosses (9) of the soleplate (2) in such a manner that the bosses (9) engage the recesses (12) of the cups (13), and performing the plastic deformation of the cups (13) and the bosses (9) in such a manner that the cups are connected to the bosses.

4 Claims, 3 Drawing Sheets

METHOD OF SECURING A COVER PLATE TO A STEAM CHAMBER OF AN IRON AND SOLEPLATE AND IRON

FIELD OF THE INVENTION

The invention relates to a method of securing a cover plate to bosses of a soleplate of a steam iron so as to form a steam chamber between the soleplate and the cover plate.

BACKGROUND OF THE INVENTION

Such a method is known from U.S. Pat. No. 4,277,900. Figure of said Patent clearly shows that ribs or bosses of the soleplate protrude through openings in the cover plate, after which the cover plate is secured to the soleplate by staking the bosses. For this method the cover plate has to be provided with openings. After the staking operation these openings will be closed to a substantial extent but in order to make the steam chamber steam-tight it is necessary to apply a sealant over the staked bosses.

SUMMARY OF THE INVENTION

An object of the invention is to provide a method by means of which a simple and effective connection of the cover plate to the soleplate can be achieved.

The method in accordance with the invention is characterized by the following steps:

- forming recesses in the cover plate in such a manner that cups are formed which project from the surface of the cover plate,
- fitting the cover plate onto the soleplate in such a manner that the bosses of the soleplate engage the recesses of the cups, and
- the performing plastic deformation of the cups and the bosses in such a manner that the cups are connected to the bosses.

The advantage of this method is that it is not necessary to form holes in the cover plate and to use a sealant. A proper sealing construction will be required only near the edges of the cover plate.

The invention also relates to a soleplate for a steam iron having a steam chamber, which is bounded by a soleplate and a metal cover plate, the cover plate being connected to bosses of the soleplate.

In accordance with the invention the cover plate has been provided with cups which project from the surface of the cover plate and which define recesses, the bosses of the soleplate engaging the recesses defined by the cups and being connected to the cups.

BRIEF DESCRIPTION OF THE DRAWINGS

The invention will now be described in more detail with reference to an exemplary embodiment shown in the drawings.

DETAILED DESCRIPTION OF THE PREFERRED EMBODIMENTS

Figure 1:
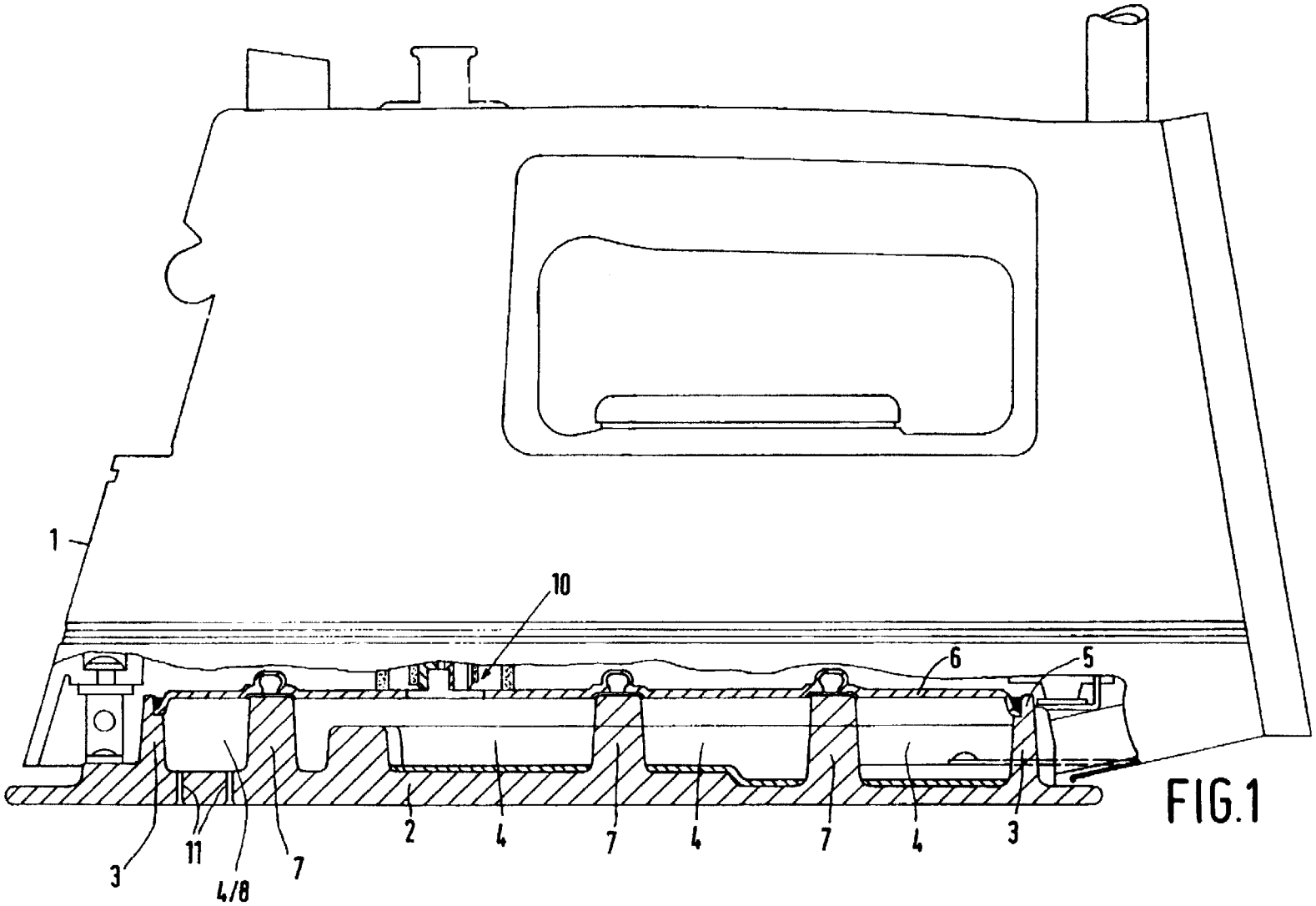
FIG. 1 shows a steam iron with the soleplate and the steam chamber shown partly in cross-sectional view.

The steam iron shown in FIG. 1 has a housing 1, which is closed by a soleplate 2 at the open side of said housing. At its side which faces the housing the soleplate has a peripheral upright wall 3, which bounds a steam chamber 4. A rim 5 of the wall 3 carries a cover plate 6, which closes the steam chamber at the top. In order to support the cover plate inside the steam chamber the soleplate further comprises upright ribs or walls 7. Such ribs or walls can be, for example, steam directing ribs or bounding walls of steam ducts 8 provided in the steam chamber. The upper sides of the ribs or walls 7 carry bosses 9. Such soleplates are generally made of cast aluminum. The ribs, walls and bosses are integrally formed during the casting process of the soleplate. FIG. 1 also shows the end portion of a metering device 10 for the supply of water to the steam chamber. The soleplate 2 further has a plurality of steam outlet ports 11.

Figure 2:
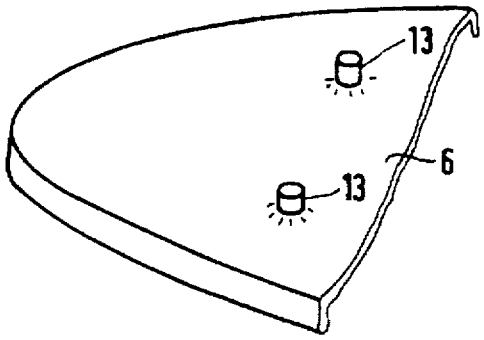
FIG. 2 shows a part of a cover plate with caps obtained by means of an extrusion process.
Figure 3:
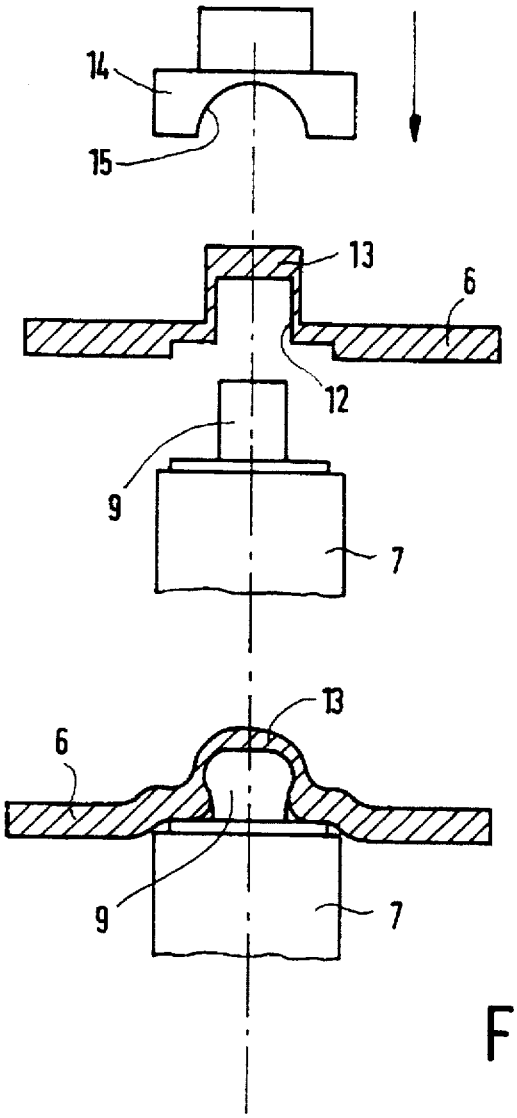
FIGS. 3–4 show two examples of securing the cover plate to the soleplate.
Figure 4:
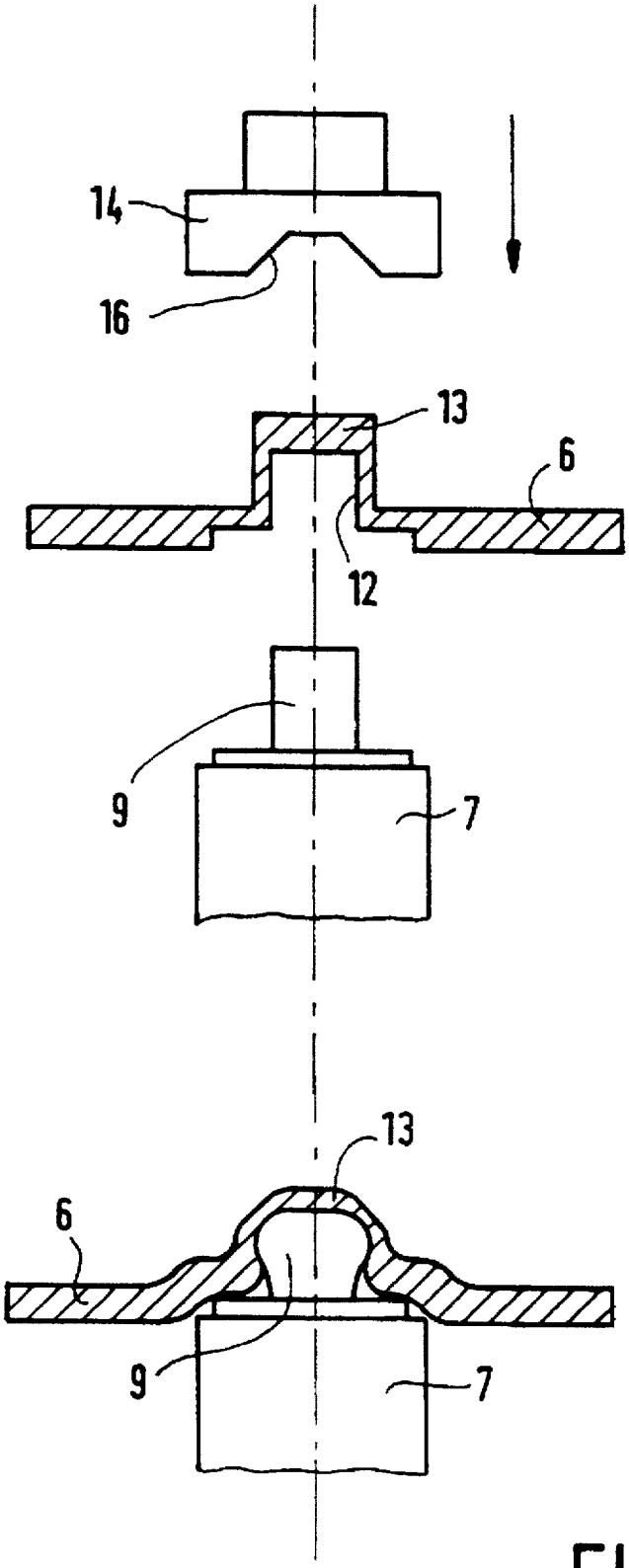

FIGS. 2–4 show in detail two examples of securing the cover plate to a boss. First of all, in all the examples, recesses 12 are formed in the cover plate 6 by means of an extrusion process, in such a manner that cups 13 are obtained, which project from the surface of the plate (see FIG. 2). Subsequently, the cover plate is placed onto the soleplate 2, the bosses 9 engaging the recesses 12 of the cups 13. After this, the cups and the bosses are subjected to plastic deformation by means of a press tool 14. During pressing the boss is upset so that a part of the boss is upset in a radially outward direction and the diameter at this location is greater than at the base of the boss. A kind of undercut is formed. Moreover, the material of the cup flows around the deformed boss. The examples show press tools of different shapes. In FIG. 3 the tool has a hollow spherical shape 15 and in FIG. 4 it has a hollow conical shape 16. Alternative shapes are also possible. However, the shape of the tool should be such that not only an axial force but also an inwardly directed force are exerted on the cup and the boss.

I claim:

1. A soleplate for a steam iron having a steam chamber, which is bounded by a soleplate and a metal cover plate, the cover plate being connected to bosses of the soleplate, wherein the cover plate has been provided with cups which project from the surface of the cover plate and which define recesses, the bosses of the soleplate engaging the recesses defined by the cups and being connected to the cups.

2. A steam iron comprising a soleplate as claimed in claim 1.

3. A method of securing a cover plate to bosses of a soleplate of a steam iron so as to form a steam chamber between the soleplate and the cover plate, which comprises the following steps:

- forming recesses in the cover plate in such a manner that cups are formed which project from the surface of the cover plate,
- fitting the cover plate onto the soleplate in such a manner that the bosses of the soleplate engage the recesses of the cups, and
- the plastic deformation of the cups and the bosses in such a manner that the cups are connected to the bosses.

4. A method as claimed in claim 3, wherein the bosses are upset during the plastic deformation and the material of the cups flows around the bosses.

* * * * *